United States Patent [19]

Hsiao

[11] Patent Number: 4,654,764

[45] Date of Patent: Mar. 31, 1987

[54] ROTARY STRUCTURE FOR THE HEAD PORTION OF AN ILLUMINATION LIGHT

[76] Inventor: Meng-Chang Hsiao, 2nd Fl., 171, Chung Hsiao E. Road, Sec. 6, Taipei, Taiwan

[21] Appl. No.: 787,176

[22] Filed: Oct. 15, 1985

[51] Int. Cl.[4] ..... F21L 1/00

[52] U.S. Cl. ..... 362/199; 362/269; 362/287; 362/371; 403/61

[58] Field of Search ..... 362/199, 269, 287, 371; 403/61, 74

[56] References Cited

U.S. PATENT DOCUMENTS

| | | | |
|---|---|---|---|
| 2,794,905 | 6/1957 | Lozeau | 362/199 X |
| 2,796,516 | 6/1957 | Martschik | 362/199 |
| 4,068,961 | 1/1978 | Ebner et al. | 403/55 |
| 4,447,863 | 5/1984 | Fenne | 362/199 |
| 4,449,171 | 5/1984 | Warshawsky | 362/413 |

*Primary Examiner*—Samuel Scott
*Assistant Examiner*—Allen J. Flanigan
*Attorney, Agent, or Firm*—Lane & Aitken

[57] ABSTRACT

A hand-held illumination device includes a body adapted to contain a battery and a head portion containing a light bulb and being rotatable relative to the body about two orthogonal axes. A connector member is mounted on the body for rotation relative thereto about a first axis, and has hook members slidingly engaging slots on a spherical portion of the head portion to permit rotation of the head portion about a second axis orthogonal to the first axis.

1 Claim, 4 Drawing Figures

ROTARY STRUCTURE FOR THE HEAD PORTION OF AN ILLUMINATION LIGHT

BACKGROUND OF THE INVENTION

Whenever a hand-held light is used for emergency illumination, once the power is connected, the body of the light has to be positioned properly and its head portion has to be turned and aimed at a given angle of elevation so as to cover the various areas that need to be illuminated in an emergency situation. When a hand-held light is used as a working light, it also needs to be capable of being turned and adjusted for angle of elevation from time to time because of space limitations that are encountered.

U.S. Pat. No. 4,447,863 discloses a hand-held light in which the front end of the housing is furnished with two legs; the ends of the legs have respective pins inserted into the holes in the interior of the head that permit the head to be moved on a center line formed by the pins for an elevation angle displacement along a round locus. Since the head is pivoted on the pins, the head cannot closely contact the housing and the handle because such contact would prevent the head from being rotated smoothly.

Moreover, the devices in the aforesaid patent can only be moved up and down for adjustment of the angle of elevation, without providing a horizontally lateral adjustment. Thus, these devices cannot illuminate the space on both sides of the light, and, therefore, do not meet the requirements for providing satisfactory emergency illumination. Also, the upper arcuate surface of the rear half of the head is marred by slits, which detract from the appearance of the light. If the slits are very short, so as to be easily concealed, the appearance of the light may not be jeopardized, but the adjustment of the angle of elevation that is provided will be limited. In addition, the legs are susceptible to breakage because they are too long to extend into the interior of the head.

SUMMARY OF THE INVENTION

This invention provides a rotary head for a light in which a swiveling bracket is mounted on the front surface of the body and the handle in a freely rotatable manner. The bracket is furnished with two hook members that extend away from said front surface. The hook members are inserted in slots on the rear half of a lamp head portion so as to engage the outer case of the head portion so that the head portion is held in close contact with the bracket and the front surface of the body and the handle, so that a displacement of an angle of elevation along the arcuate surface of the rear half of the head is provided and said head portion rotates together with said bracket, whereby the head portion can be adjusted to a predetermined position. Since the head portion is rotatable, the aforesaid slots can be furnished in the lower arcuate surface of the rear half portion of the head portion, which avoids jeopardizing the overall appearance of the light.

DESCRIPTION OF THE PREFERRED EMBODIMENT

Figure 1:
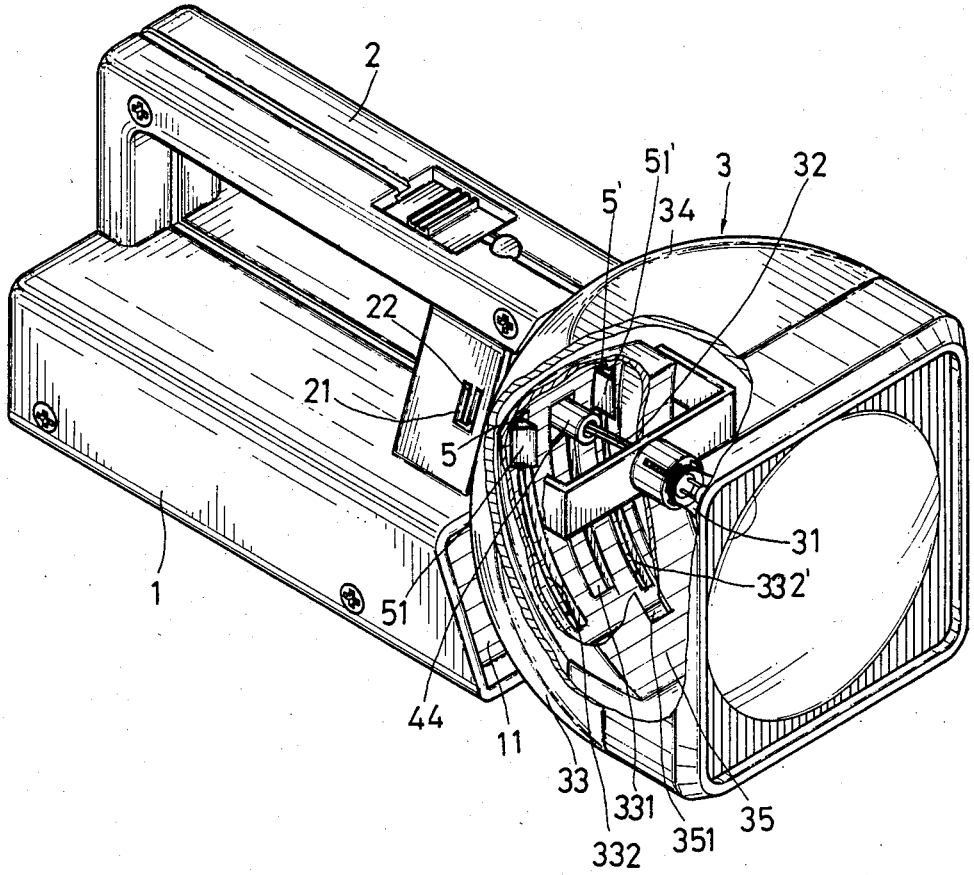
FIG. 1 is a cutaway perspective view of the head assembly of a light according to the present invention.
Figure 2:
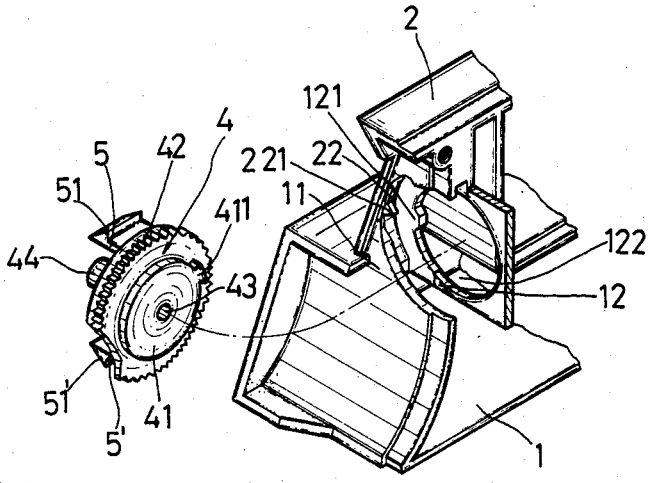
FIG. 2 is a sectional exploded view of a light according to the present invention.

Referring to FIG. 1, there is shown an embodiment of the present invention, which comprises a body 1, a handle 2, and a lamp head portion 3. Referring to FIG. 2, there is shown the rotary structure of the head portion 32 of the present invention, in which the front surface of the body 1 and the handle 2 are attached to a swivel bracket 4. The bracket 4 is fixedly fitted with two hook members 5 and 5'. The bracket 4 is mounted between the front housing 11 and a positioning plate 12.

On the rear side of the swivel bracket 4, there is mounted with a disc 41 that is positioned exactly in a round hole 122 so as to have a stop member 411 on the back of the swivel bracket 4 touch a projecting piece 121 in the positioning plage 12 after the stop member 411 has rotated approximately 360 degrees, the stop member 411 preventing rotation through more than 360 degrees to prevent the wires of the head portion 3 from being wound around upon turning the head portion 3.

Figure 3:
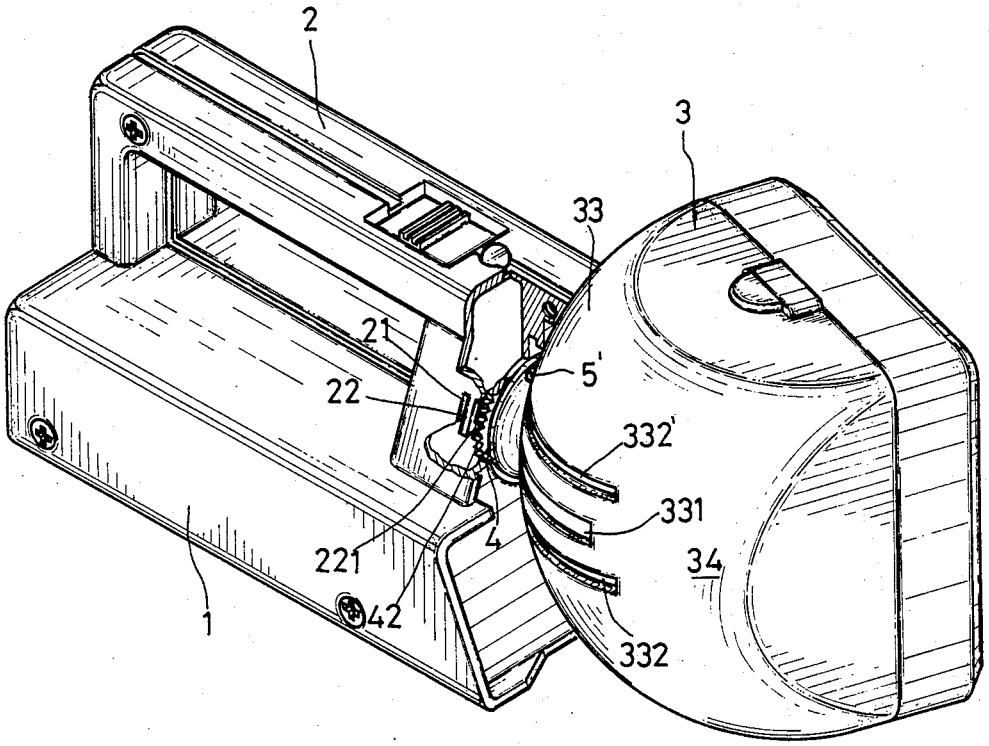
FIG. 3 is a cutaway perspective view of the front portion of the handle of a light according to the present invention.

Further, an outer rim of the bracket 4 is furnished with a plurality of detent teeth 42, and one side of the front end of the handle 2 is furnished with a U-shaped slit 21 (as shown in FIG. 1). The portion remaining between the two legs of the U-shaped slit 21 provides a leaf spring 22 having a protruding point 221 on its distal end which engages the teeth 42 on the rim of the bracket as shown in FIG. 3. The detent teeth 42 and leaf spring 22 permit the bracket be rotated tooth by tooth, and also to be securely held at a given detent position.

Again, referring to FIGS. 1 and 2, the bracket 4 has a center hole 43, which is connected with a protruding hollow cylinder 44, through which the electric wires 32 may pass into the head portion 3 so as to be connected with the bulb 31. The lower arcuate surface 33 of the rear half of the head portion 3 has a central slot 331, and on the upper portion of the slot cover 35, there is a notch 351 in which the protruding hollow cylinder 44 moves when the angle of elevation is changed and the electric wires 32 enter the head portion 3.

Further, the lower arcuate surface of the rear half of the head portion 3 has two parallel slots 332 and 332'. The space between the two slots is the same as the space between the two hook members 5 and 5'. The width of the slots 332 and 332' is exactly wide enough to permit the two hooks 51 and 51' of the two hook members 5 and 5' to be inserted therein, as shown in FIG. 1, to attach the hook members 5 and 5' to the rear half of the head portion 3.

The length of the hook members 5 and 5' may be advantageously reduced so that the head portion 3 can closely contact the bracket 4 and the front surface of the body 1 and handle 2. Various points on the arcuate surface of the rear half of the head portion 3 can also be shaped to provide close contact with the center of the bracket 4 to stabilize the elevation angle adjustment. Therefore, the shaped arcuate surface of the rear half portion may be selected to meet various practical needs.

Since the head portion 3 can be turned by rotating the swivel bracket 4, the slots 332 and 332' need be furnished only in the lower arcuate surface of the rear half of the head portion 3. The slots need not be furnished in the upper arcuate surface 34, and so, a better appearance for the head portion is provided. FIG. 3 shows that after the head portion 3 has been rotated, an elevation angle can also be adjusted so as to have the head portion 3 pointed in a given direction for illuminating a space, as desired. The light of the present invention also satisfactorily meets emergency illumination requirements in that it can be used as an emergency illumination light by setting it in the position desired first and then turning the head portion in the desired direction.

Figure 4:
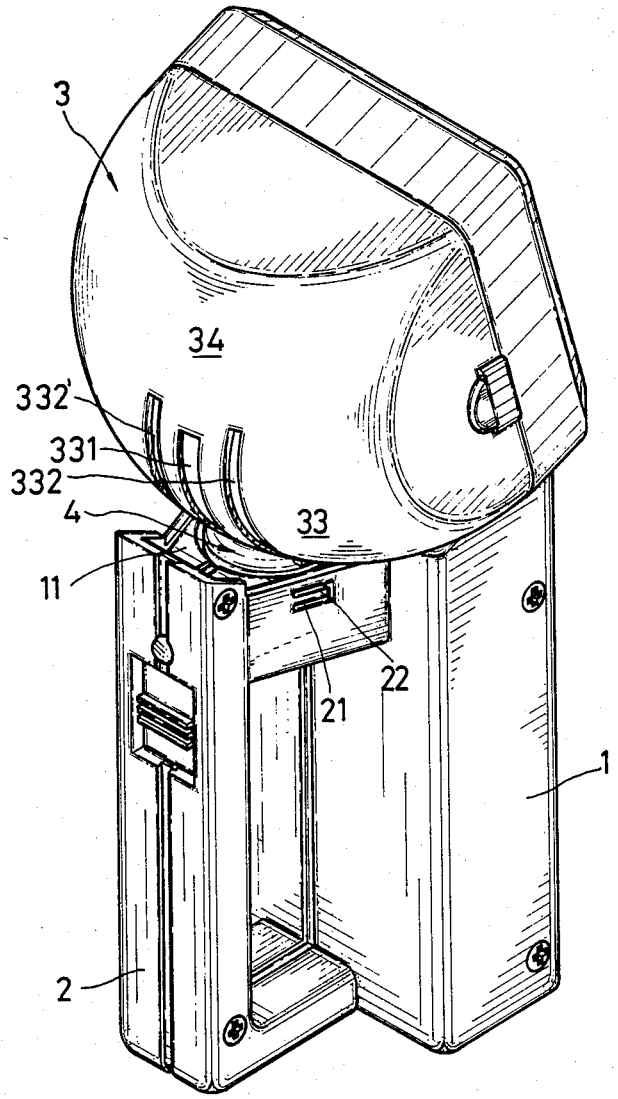
FIG. 4 is a perspective view of a light according to the present invention set in a vertical position.

Referring to FIG. 4, a light according to the present invention is shown set vertically on a plane to direct the elevation angle of the light for proving illumination. Since the head portion 3 can be adjusted at any elevation angle, and can be rotated, the light may be placed in a position that avoids holding the light with one hand and working with the other hand, as the conventional hand-held light usually requires.

It will be apparent to one skilled in the art that variations and modifications of the disclosed invention are possible without departing from the spirit and scope of the present invention as defined in the appended claims. For example, the hook members 5 and 5' may be furnished directly on the front edges of the body 1 and the handle 2 of the present invention without the swivel bracket 4. In that case, only its elevation angle will be adjustable.

I claim:

1. A self-powered illumination device comprising a head portion and a body, said body being adapted to contain an energy source and to supply energy to said head portion, said head portion containing a light source to be powered by energy supplied by said energy source, and having a rear portion which has an essentially spherically shaped portion having at least two parallel slots thereon; and a connector member disposed between said body and said head portion and mounted on said body for rotation relative thereto about a first axis, said connector member having at least two hook members which are inserted into and slidingly engage said slots to permit rotation of said head portion relative to said body about a second axis containing the center of said spherically shaped portion, said second axis being orthogonal to said first axis.

* * * * *